United States Patent [19]

Hall

[11] 4,250,973

[45] Feb. 17, 1981

[54] ROCK DRILLING APPARATUS

[76] Inventor: James D. Hall, Box 47, Atlin, British Columbia, Canada, V0W 1A0

[21] Appl. No.: 17,140

[22] Filed: Mar. 5, 1979

[51] Int. Cl.[3] ..... B23Q 5/00; E21C 5/00

[52] U.S. Cl. ..... 173/147

[58] Field of Search ..... 173/147, 160, 152; 175/220

[56] References Cited

U.S. PATENT DOCUMENTS

| | | | |
|---|---|---|---|
| 1,445,086 | 2/1923 | Joy | 173/147 X |
| 2,781,185 | 2/1957 | Robbins | 175/220 X |
| 3,402,777 | 9/1968 | Watson | 173/147 |
| 3,757,858 | 9/1973 | Davis et al. | 173/147 |
| 3,915,243 | 10/1975 | Hisey | 173/147 |
| 3,994,350 | 11/1976 | Smith | 173/147 |
| 4,137,974 | 2/1979 | Decker | 173/147 |

*Primary Examiner*—Ronald Feldbaum

*Attorney, Agent, or Firm*—Carver and Company

[57] ABSTRACT

Rock drilling apparatus wherein a motor and chuck assembly is mounted for slidable movement on a mast and elevated and lowered by a pair of endless chains, the endless chains passing through openings in stabilizer units slidably mounted on the mast for vertical movement and which rotatably and slidably brace the drill stem. The chains carry detents which are arranged so that when the endless chains are operated to elevate the motor and chuck, the stabilizers are also elevated in spaced relationship so as to stabilize the drill stem.

3 Claims, 5 Drawing Figures

ROCK DRILLING APPARATUS

BACKGROUND OF THE INVENTION

1. Field of the Invention

This invention relates to rock drilling apparatus, and in particular to the stabilizer assembly for providing lateral support for an unsupported length of drill stem extending upwardly out of the drill hole.

2. Prior Art

Diamond drilling apparatus normally uses a hollow sectionalized drill stem which is subjected to downward pressure as it is rotated so that a bit at the lower end of the drill stem bores into the rock. Circulating water is fed under pressure through the upper end of the drill stem to the bit and serves to cool the bit and deflects the cuttings from the bottom of the hole. As the drill stem follows the bit down the hole, additional lengths of stem are added as may by needed.

In many rock drilling assemblies, the drill stem is embraced by a driven rotatable chuck mounted for vertical travel on a mast and which is capable of remote chucking and de-chucking operations to be carried out during a drilling operation. Due to the heavy downward pressure which must necessarily be applied by the chuck to the drill stem, a tendency of the stem to deflect under load requires that its unsupported length above the drill hole be kept at a minimum. Consequently, this requires a number of chucking and de-chucking operations for each length of drill stem during a drilling operation. Understandably, time taken in a chucking and de-chucking operation is lost time in so far as a drilling operation is concerned.

SUMMARY OF THE INVENTION

The present invention provides a means for providing lateral support for a drill stem below the chuck and thereby enabling the chuck to be elevated the full length of a new drill stem section so as to avoid the necessity of multiple de-chucking and chucking operations for each section as a drilling operation progresses.

In the present invention, a plurality of stabilizer units slidably mounted on the mast for vertical travel rotatably and slidably embrace the drill stem and automatically elevated in selected spaced relationship by endless chain means which also elevate the chuck so as to provide lateral support for the drill stem below the chuck.

A detailed description following, related to the drawings, gives exemplification of apparatus according to the invention which, however, is capable of expression in means other than those particularly described and illustrated.

DETAILED DESCRIPTION

Figure 1:
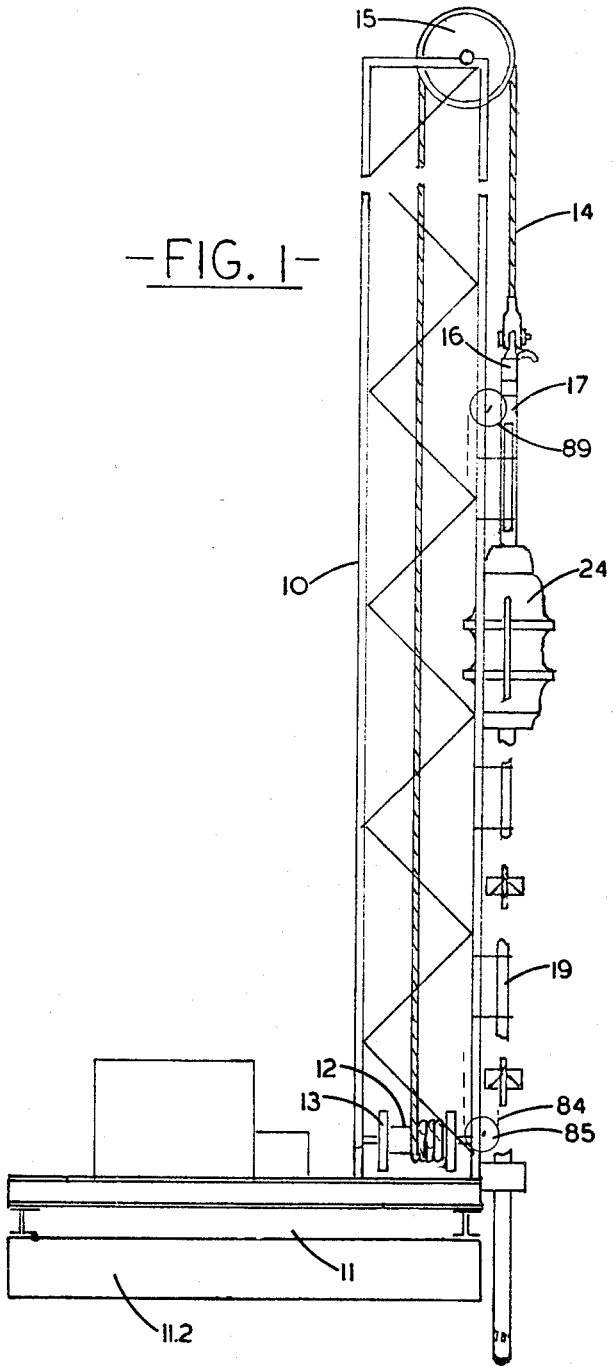
FIGS. 1 and 2 are side and front elevations of the diamond drilling apparatus embodying the stabilizing apparatus of the invention, elements thereof being shown in the main diagramatically and with portions removed for purposes of clarification.
Figure 2:
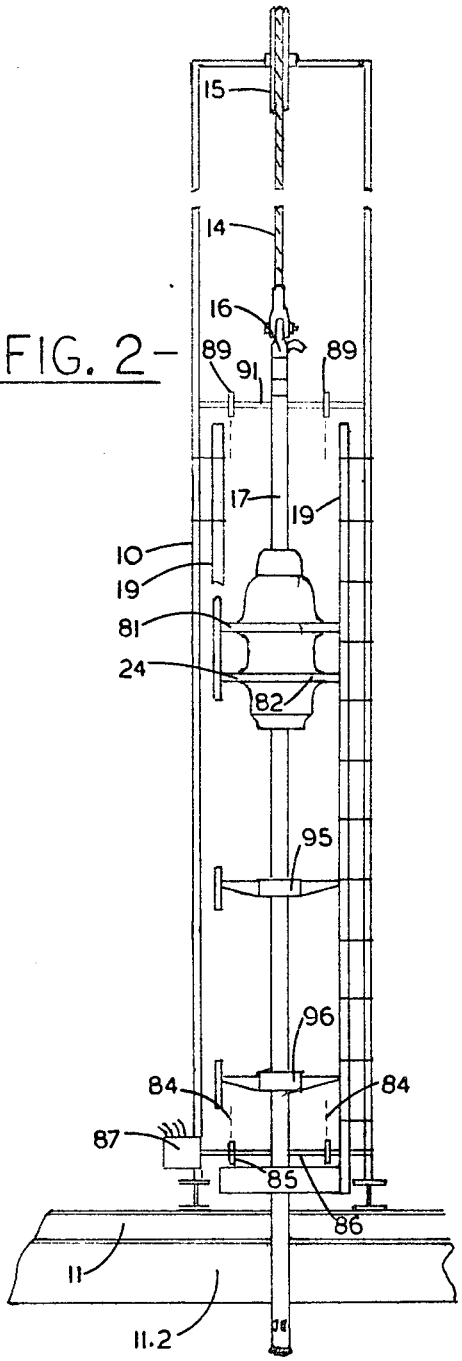

Referring to the drawings, in particular to FIGS. 1 and 2, there is shown conventional drilling apparatus which includes a mast 10 mounted on a base 11 and draw works 12 which includes a winding drum 13, having a cable 14 passing over a sheave 15, the cable 14 being connected to a water swivel 16 which is connectable in a known manner to the upper end of drill stem 17. The base 11 includes a structural frame 11.1 to which is secured ballast tanks 11.2 which can, prior to commencement of a drilling operation, be filled with water to act as ballast.

Mounted on the mast 10 are a pair of vertically disposed "C" shaped guide tubes 19. The tubes 19 serve as guides for a hydraulically operated chuck and motor assembly 24 which is of a known type remotely operated into a gripping or release position with the drill stem 17 so as to enable it to be positioned longitudinally of the drill stem or to be clamped tightly thereon to rotate and apply pressure on the drill stem in the drilling operation.

Figure 3:
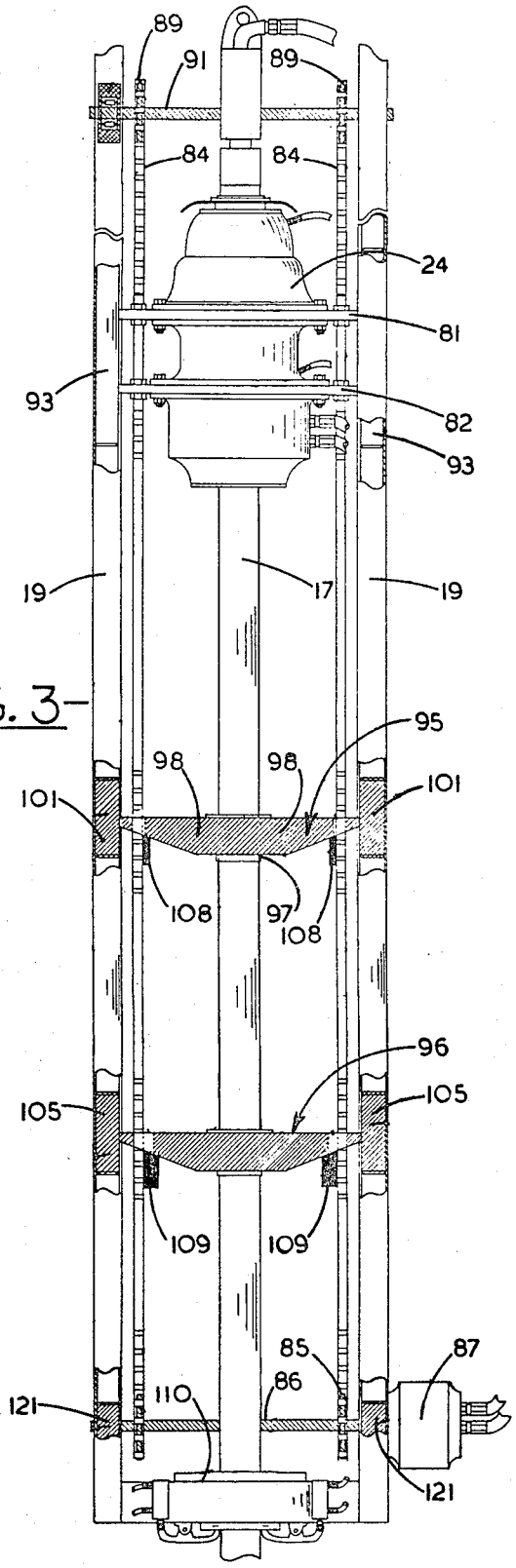
FIG. 3 is an enlarged front elevation of the drilling apparatus shown in FIG. 1, showing more particularly the stabilizing unit thereof.
Figure 4:
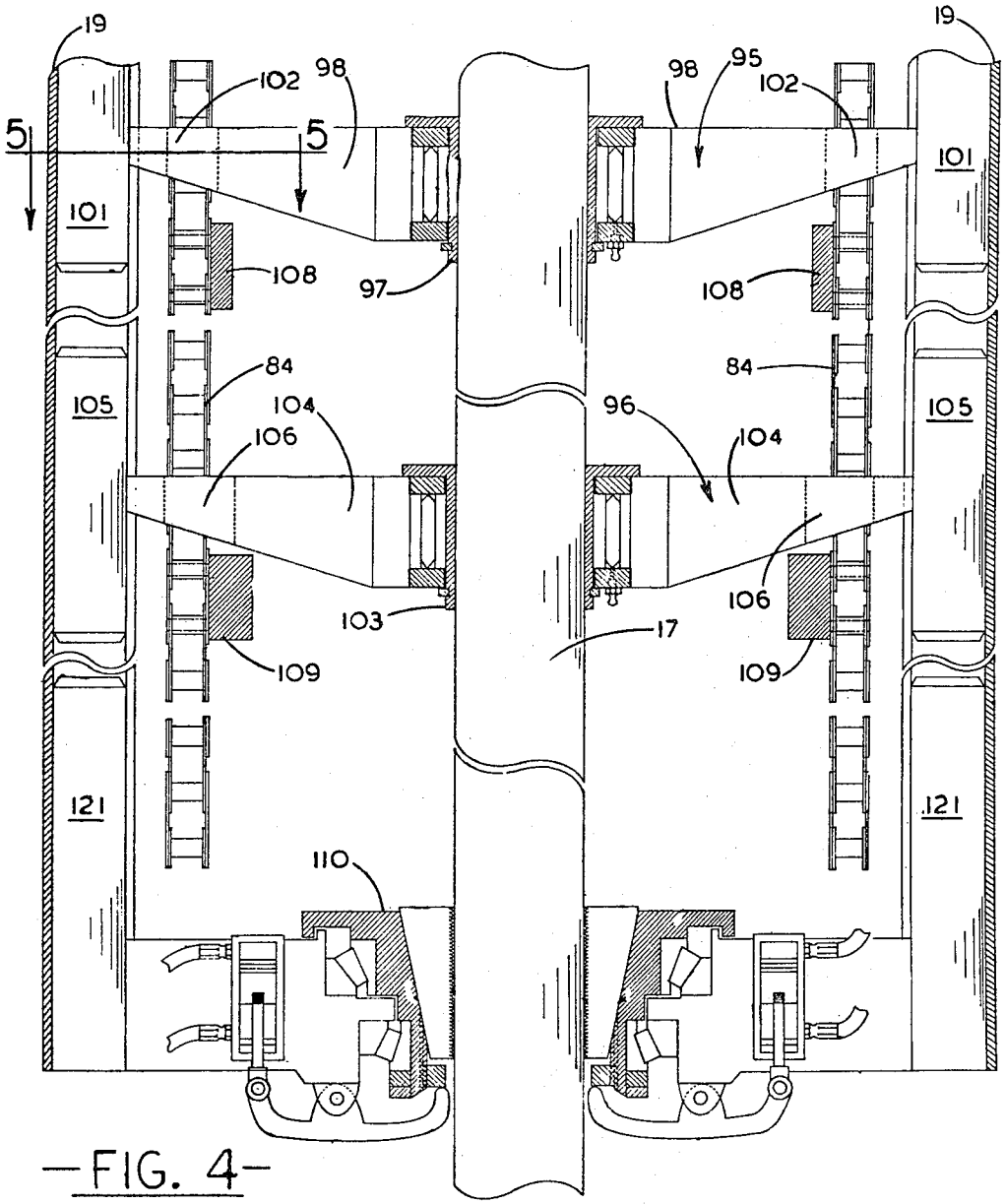
FIG. 4 is an enlarged front elevation of a portion of the drilling apparatus showing in particular detail of the stabilizing apparatus of the invention.
Figure 5:
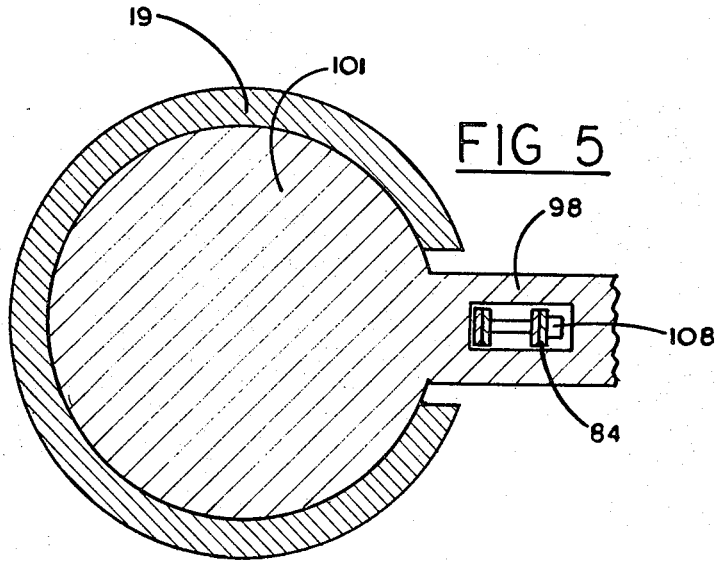
FIG. 5 is an enlarged sectional view taken on Line 5—5 of FIG. 4.

The chuck and motor assembly 24, see FIGS. 3 and 4, has laterally extending arms 81 and 82 which are connected to outer runs of a pair of endless chains 84. The endless chains pass over lower sprockets 85 which are mounted on a transverse drive shaft 86 driven by a hydraulic motor 87 and also pass over idler sprockets 89—89 mounted on a transverse shaft 91 which, like the shaft 86, is mounted on the mast for rotation. The motor 24 is guided for vertical travel by means of elongated guide elements 93—93 carried on the ends of the arms 81 and 82 and which have a slidable fit in the guide tubes 19.

The guide tubes support a pair of stabilizers 95 and 96. The stabilizer 95 has a collar 97 through which the drill stem 17 has a rotatable and slidable fit. A pair of laterally extending arms 98—98 are hingedly connected to the collar and are connected at their ends to elongated guide elements 101—101 having a slidable fit in the guide tubes. The arms 98—98 have passages 102—102 through which the endless chains can pass freely. The stabilizer 96 similarly has a collar 103 and extending arms 104—104 connected to guide elements 105—105. The arms 104—104 have passages 106—106 larger than the passages 102—102 through which the endless chains can slidably pass.

The endless chains have mounted thereon a pair of transversely aligned upper detent blocks 108—108 spaced below the assembly 24 and a pair of lower detent blocks 109—109 spaced below the upper detent blocks. The size, shape and location of the detent blocks 108 is such that they can pass with the endless chain through the passages 106 of the stabilizer 96 but not through the passages 102 of the stabilizer 95. The size of the detent blocks 109 is such that they cannot pass through the passages 106 of the stabilizer 96. The detent blocks are also located so that when the motor assembly 24 is raised to its highest normal operating position above a snubbing device 110, which is mounted on the base, a distance substantially the length of a section of drill stem. The stem, it is seen, is laterally supported by the motor assembly 24, the stabilizers and the snubbing assembly at equidistantly space intervals.

Construction of the drilling apparatus as hereinbefore described enables continuous, uninterrupted rotation of the drill stem as it is advanced for a length of a drill stem section. Referring to FIG. 3, when one section of the drill stem is added to the drill string the motor and chuck assembly 24 is elevated to its highest or starting position to engage the added drill stem section at its upper end. In this position, the stabilizers are elevated by the detent blocks 108 and 109 and provide lateral support for the drill stem at equidistantly spaced intervals. During a drilling operation, as the drill stem is advanced into the hole, the stabilizers and the assembly 24 move downwards, the stabilizer 96 finally coming to rest on stops 121—121 just above the snubber. The detent block 109 however will continue downward movement and pass around the sprockets 85. The stabilizer 95 will also move downward until it comes to rest upon the stabilizer 96 allowing the detent blocks 108 to pass through the passages 106 in the stabilizer 96 and also pass around the sprockets 85. The downward travel of the motor is halted in a position which is just clear of the stabilizer 95.

When the assembly 94 reaches its lowest point of travel, a new drill stem section is added and the assembly 24 then raised by operation of the endless chains to its highest position, the stabilizers taking up their original spaced apart positions to stabilizer the new drill stem.

With the drill apparatus, as above described, it is evident that in a drilling operation elevating and lowering and chucking and de-chucking operations of the assembly 24, operation of the snubber and the draw works, can be remotely controlled from one station which consequently enhances the safety aspect. Further, drill stem sections can be longer than what is now conventionally used due to the provision of the stabilizers so as to materially reduce costs of operation.

I claim:

1. A stabilizing apparatus for stabilizing the drill stem of a rock drill drilling assembly wherein the assembly has a mast having a base, and a vertically movable driven chuck for rotating the drill stem, the stabilizing apparatus comprising:

(a) a pair of vertically disposed parallel guide rails mounted on the mast, (b) means for connecting the chuck to and between the rails for vertical sliding movement, (c) a pair of endless driving elements mounted on the mast on opposite sides of and connected to the chuck for elevating and lowering the latter, (d) at least one collar assembly slidably mounted on the rails for vertical movement, the collar assembly having a collar for rotatably and slidably receiving the drill stem and arms extending from the collar, the arms having passages through which the endless driving elements freely pass, (f) detent elements mounted on the endles driving elements below the collar assembly adapted to engage the collar assembly for elevating the latter when the driving elements are operated to elevate the chuck so as to provide rotatable support for the drill stem between the chuck and mast base.

2. Apparatus as claimed in claim 1 including:

(a) a second collar assembly disposed below the first mentioned collar element, said second collar assembly having laterally extending arms having passages larger than the passages of the first mentioned collar assembly, (b) a second pair of detent elements mounted on the second collar assembly below the first mentioned second collar assembly for engagement with the arms of the second collar assembly when the driving elements are operated to lift the chuck, (c) relative size of the first mentioned detent elements and the passages in the arms of the second collar assembly enabling free passage of the first mentioned detent elements therethrough.

3. Apparatus as claimed in claim 1 in which the arms of each collar assembly are hingedly connected to their associated collars.

* * * * *